US008992192B2

(12) United States Patent
Shah et al.

(10) Patent No.: US 8,992,192 B2
(45) Date of Patent: Mar. 31, 2015

(54) INPUT SHAFT LUBRICATION FOR GEAR PUMP

(75) Inventors: Satish Shantilal Shah, Rockford, IL (US); Michael R. Blewett, Stillman Valley, IL (US); Timothy P. Walgren, Byron, IL (US); Michael Moorman, Belvidere, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 915 days.

(21) Appl. No.: 13/034,965

(22) Filed: Feb. 25, 2011

(65) Prior Publication Data

US 2012/0219444 A1 Aug. 30, 2012

(51) Int. Cl.

| | |
|---|---|
| ***F04C 29/02*** | (2006.01) |
| ***F16C 1/24*** | (2006.01) |
| ***F04C 2/14*** | (2006.01) |
| ***F01C 19/00*** | (2006.01) |
| ***F01C 21/00*** | (2006.01) |
| ***F04C 15/00*** | (2006.01) |

(52) U.S. Cl.

CPC ..... *F04C 2/14* (2013.01); *F01C 19/005* (2013.01); *F01C 21/007* (2013.01); *F04C 15/0038* (2013.01); *F04C 15/0073* (2013.01); *F04C 15/0092* (2013.01); *F04C 2240/603* (2013.01)

USPC ..... 418/91; 418/94; 418/206.8; 184/6.12; 184/6.16

(58) Field of Classification Search

USPC ..... 418/83, 91, 94, 205, 206.8; 464/24, 26; 184/6.12, 6.16

See application file for complete search history.

(56) References Cited

U.S. PATENT DOCUMENTS

| | | | | |
|---|---|---|---|---|
| 1,902,346 | A | | 3/1933 | Vogt |
| 2,195,886 | A | * | 4/1940 | Hawley, Jr. ..... 418/206.2 |
| 2,301,496 | A | | 11/1942 | Aldrich |
| 2,756,684 | A | | 7/1956 | Renzo |
| 3,018,641 | A | | 1/1962 | Carpigiani |
| 3,045,778 | A | | 7/1962 | Mosbacher |
| 3,182,596 | A | | 5/1965 | Prijatel |
| 3,204,565 | A | | 9/1965 | Kirkpatrick |
| 3,230,796 | A | * | 1/1966 | Thomson ..... 184/6.12 |
| 3,380,555 | A | * | 4/1968 | Myers et al. ..... 184/6.12 |
| 3,435,773 | A | | 4/1969 | Gustafsson |
| 3,824,041 | A | | 7/1974 | Rystrom |
| 3,833,317 | A | | 9/1974 | Rumsey |

(Continued)

FOREIGN PATENT DOCUMENTS

JP 2000-046158 2/2000

OTHER PUBLICATIONS

Chinese Search Report for CN Application No. 201210043600.7 mailed May 30, 2014.

*Primary Examiner* — Mary A Davis
(74) *Attorney, Agent, or Firm* — Carlson, Gaskey & Olds, P.C.

(57) ABSTRACT

A shaft assembly includes a gear with a gear bore having a splined bore section adjacent to an oil dam. A shaft includes a first splined end section and a second splined end section, the first splined end section engageable with the splined inner diameter, the shaft having a bore with a bore diameter greater than a diameter of the oil dam, a first set of radial apertures axially inboard of the first splined end section in communication with the shaft inner bore and a second set of radial apertures axially inboard of the second splined end section in communication with the shaft inner bore that altogether provide lubrication of the splined end sections.

11 Claims, 14 Drawing Sheets

(56) References Cited

U.S. PATENT DOCUMENTS

| | | | | |
|---|---|---|---|---|
| 4,097,206 | A | 6/1978 | Schonherr | |
| 4,290,739 | A | 9/1981 | Korse | |
| 4,399,720 | A * | 8/1983 | Cuppett | 81/3.37 |
| 4,631,009 | A | 12/1986 | Cygnor et al. | |
| 5,004,407 | A | 4/1991 | Hutchison | |
| 5,071,328 | A | 12/1991 | Schlictig | |
| 5,547,056 | A * | 8/1996 | Stone et al. | 464/24 |
| 5,586,875 | A | 12/1996 | Ondrejko et al. | |
| 6,135,741 | A | 10/2000 | Oehman, Jr. | |
| 6,138,646 | A | 10/2000 | Hansen et al. | |
| 6,223,775 | B1 | 5/2001 | Hansen et al. | |
| 6,241,498 | B1 | 6/2001 | Hansen et al. | |
| 6,321,527 | B1 | 11/2001 | Dyer et al. | |
| 6,474,444 | B1 * | 11/2002 | Mochizuki | 184/6.12 |
| 6,705,847 | B1 | 3/2004 | Sagawe et al. | |
| 7,094,042 | B1 | 8/2006 | Borgetti et al. | |
| 7,878,781 | B2 | 2/2011 | Elder | |
| 2002/0061256 | A1 | 5/2002 | Hansen et al. | |
| 2006/0024188 | A1 | 2/2006 | Muscarella et al. | |
| 2007/0178003 | A1 | 8/2007 | Zhu et al. | |
| 2009/0148333 | A1 | 6/2009 | Elder | |
| 2009/0159370 | A1 * | 6/2009 | Maners et al. | 184/6.12 |
| 2010/0283341 | A1 * | 11/2010 | Grosskopf et al. | 192/69.2 |
| 2011/0129291 | A1 * | 6/2011 | Humes | 403/40 |

* cited by examiner

INPUT SHAFT LUBRICATION FOR GEAR PUMP

BACKGROUND

The present disclosure relates to a pump, and more particularly to a fuel gear pump for gas turbine engines.

Fuel gear pumps are commonly used to provide fuel flow and pressure for gas turbine engines and other systems on aircrafts. The gear pump must perform over a wide system operating range and provide critical flows and pressures for various functions. Typically, these pumps receive rotational power from an accessory gearbox through a drive shaft.

In a dual gear stage pump, rotational power is transferred from one gear stage to the other gear stage through an input shaft and coupling shaft. Each shaft usually has splines to transfer input shaft rotation into the respective gear stages. To minimize wear and meet all performance requirements throughout the pump service life, the splines may be lubricated during operation.

SUMMARY

A shaft assembly according to an exemplary aspect of the present disclosure includes a shaft with a first radial shoulder and a second radial shoulder, an axial separation between the first radial shoulder and the second radial shoulder defines an axial distance SA along an axis and each of said radial shoulders defines an outer diameter SD, a ratio of SA/SD defined between 0.19 -0.45.

A shaft assembly according to an exemplary aspect of the present disclosure includes a gear with a gear bore having a splined bore section adjacent to an oil dam. A shaft includes a first splined end section and a second splined end section, the first splined end section engageable with the splined inner diameter, the shaft having a bore with a bore diameter greater than a diameter of the oil dam, a first set of radial apertures axially inboard of the first splined end section in communication with the shaft inner bore and a second set of radial apertures axially inboard of the second splined end section in communication with the shaft inner bore.

A gear pump according to an exemplary aspect of the present disclosure includes a gear with a gear bore having a splined bore section adjacent to an oil dam. A shaft includes a first splined end section and a second splined end section, the first splined end section engageable with the splined inner diameter, the shaft having a bore with a bore diameter greater than a diameter of the oil dam, a first set of radial apertures axially inboard of the first splined end section in communication with the shaft inner bore and a second set of radial apertures axially inboard of the second splined end section in communication with the shaft inner bore. A coupling shaft is located along a coupling shaft axis parallel to the input shaft axis.

A method of lubricating a shaft within a housing according to an exemplary aspect of the present disclosure includes communicating a lubricant into a shaft inner bore, transferring the lubricant between a first splined end section and a second splined end section, collecting the lubricant within the shaft inner bore, and draining the lubricant from the shaft inner bore when the level of the lubricant reaches an oil dam inner aperture.

A method of installing a shaft according to an exemplary aspect of the present disclosure includes installing a shaft having a shaft inner bore into a gear, the shaft inner bore having a diameter greater than an oil dam.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
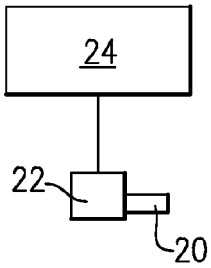
FIG. 1 is a block diagram of a gear pump driven by an accessory gearbox to communicate a fluid such as fuel to a gas turbine.

FIG. 1 schematically illustrates a gear pump 20 driven by an accessory gearbox 22 to communicate a fluid such as fuel to a gas turbine 24. It should be appreciated that the present application is not limited to use in conjunction with a specific system. Thus, although the present application is, for convenience of explanation, depicted and described as being implemented in an aircraft fuel pump, it should be appreciated that it can be implemented in numerous other systems. In addition, although a dual stage gear pump is disclosed, other machines with a shaft will also benefit herefrom.

Figure 2:
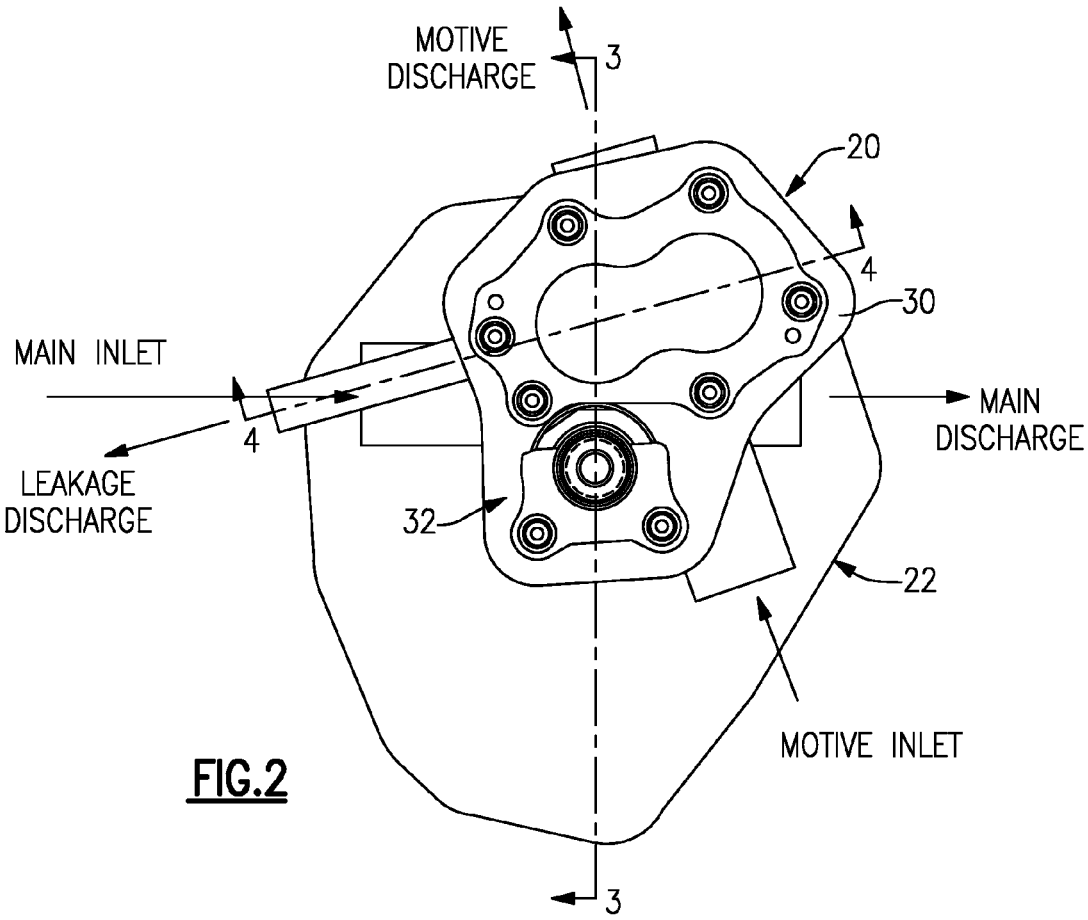
FIG. 2 is an end view of a gear pump.
Figure 3:
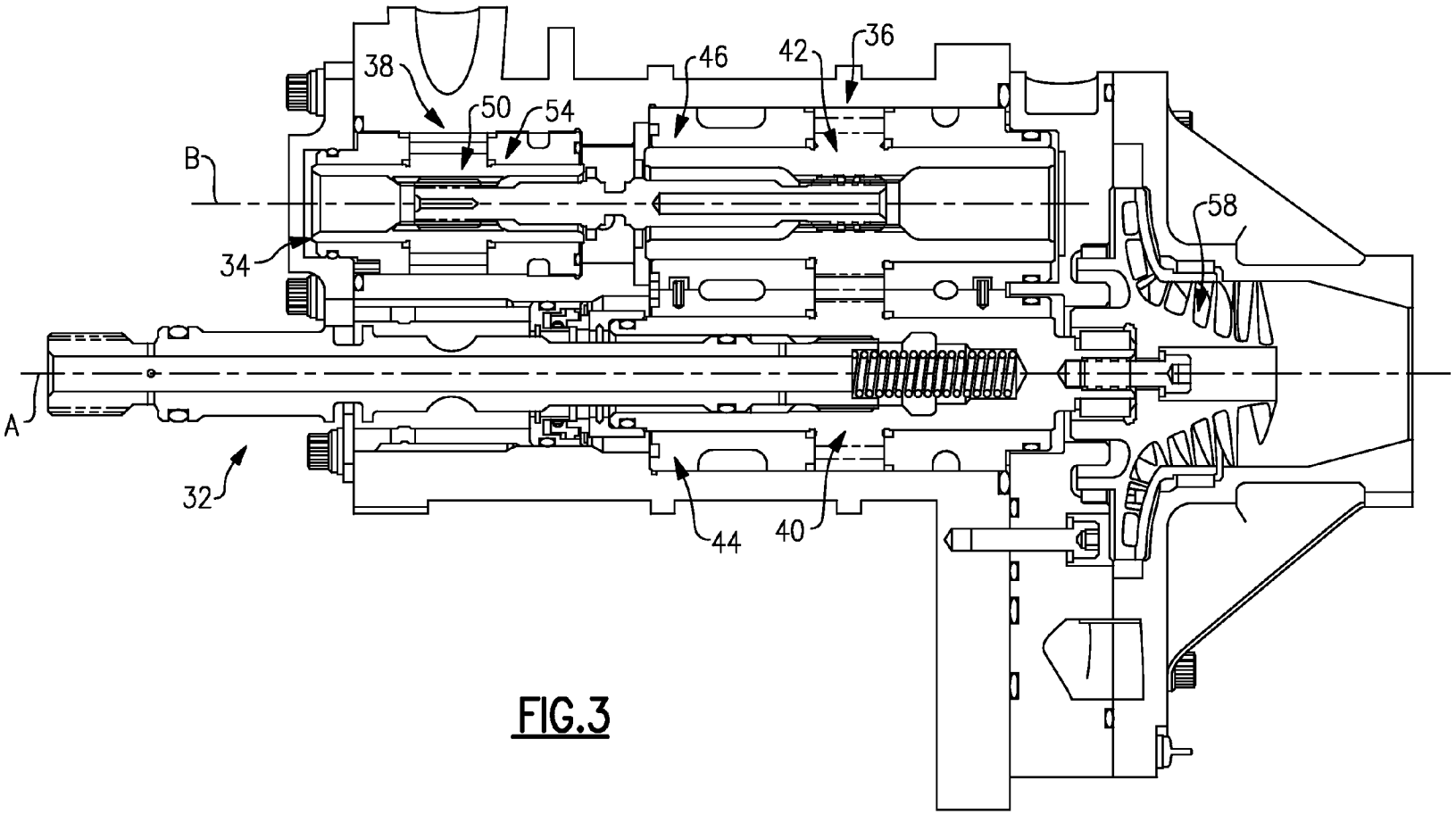
FIG. 3 is a sectional view of the gear pump taken along line 3-3 in FIG. 2.
Figure 4:
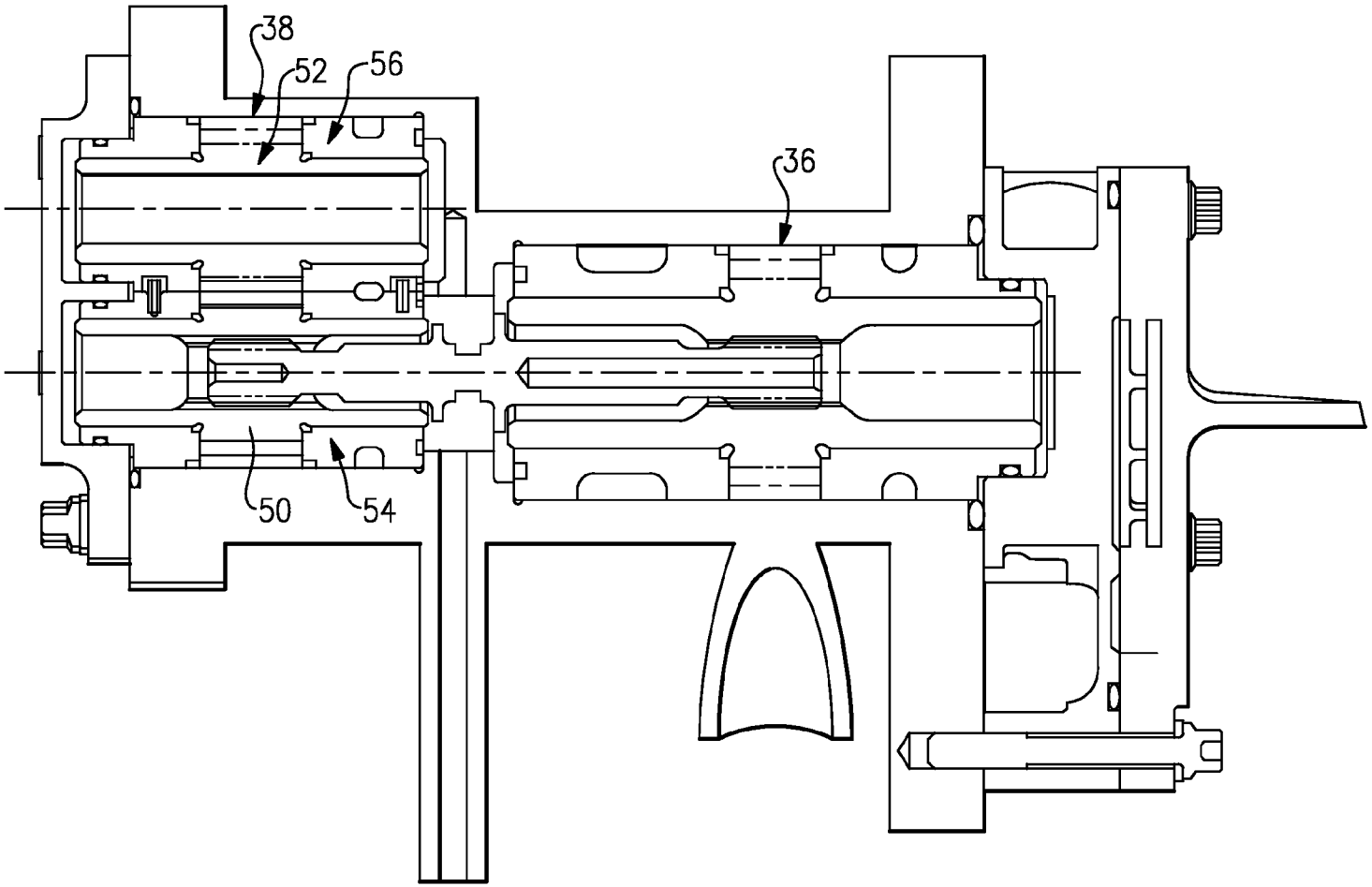
FIG. 4 is a sectional view of the gear pump taken along line 4-4 in FIG. 2.

With reference to FIG. 2, the gear pump 20 generally includes a housing 30 that includes an input shaft assembly 32 and a coupling shaft assembly 34 to power a main stage 36 and a motive stage 38 (FIGS. 3 and 4). Rotational power is transferred from the gas turbine 24 to the accessory gearbox 22 then to the gear pump 20 through the input shaft assembly 32. In the disclosed, non-limiting embodiment, the input shaft assembly 32 interfaces with the accessory gearbox 22 and receives a lubricant therefrom while the coupling shaft assembly 34 is lubricated with fuel.

With reference to FIG. 3, the input shaft assembly 32 is defined along an input axis A and the coupling shaft assembly 34 is defined along a coupling axis B parallel to the input axis A. The main stage 36 generally includes a main drive gear 40, a main driven gear 42, a main drive bearing 44 and a main driven bearing 46. The motive stage 38 generally includes a motive drive gear 50, a motive driven gear 52, a motive drive bearing 54 and a motive driven bearing 56 (FIG. 4).

Figure 5:
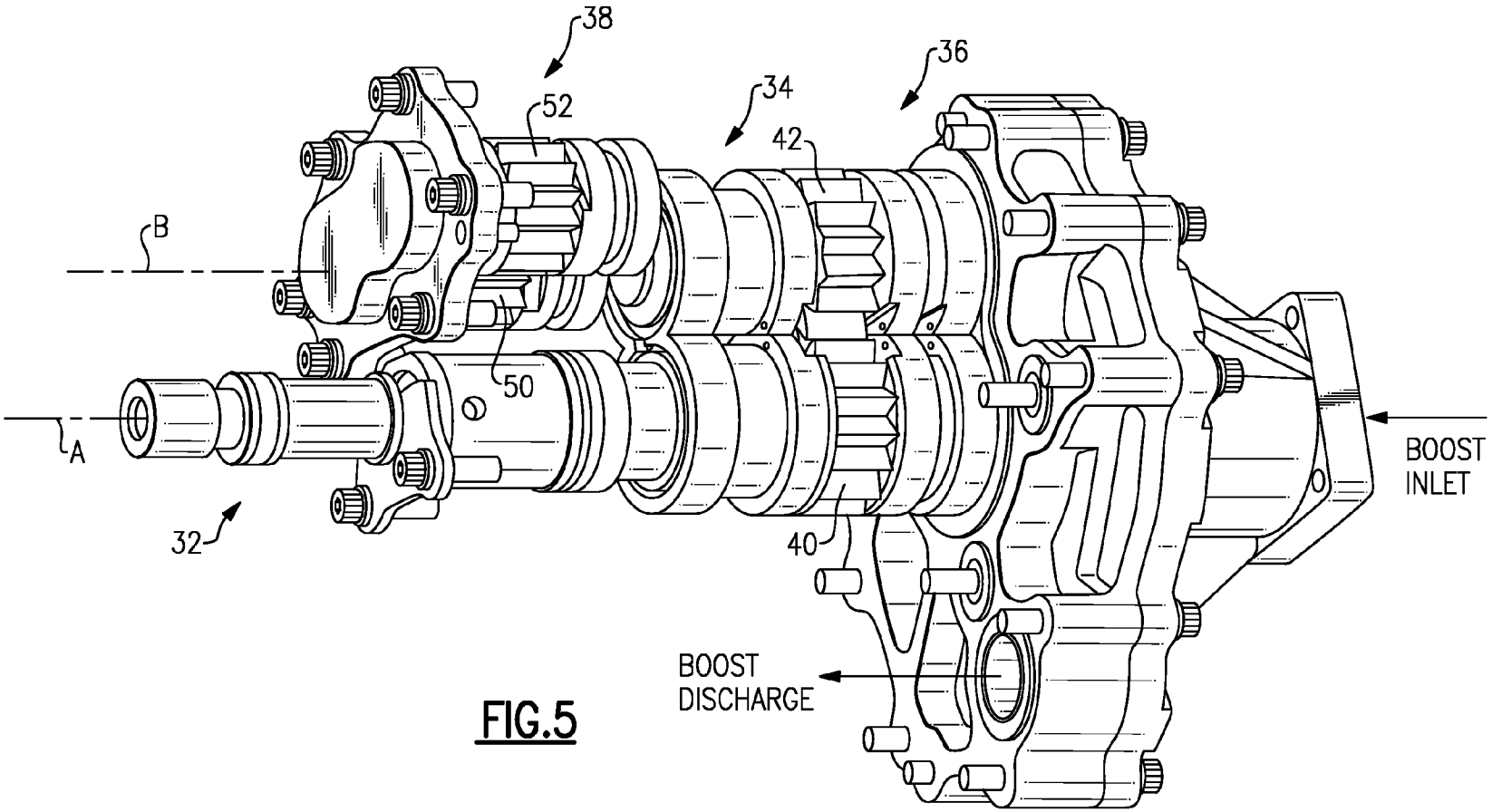
FIG. 5 is a perspective view of the gear pump with the housing removed.
Figure 6:
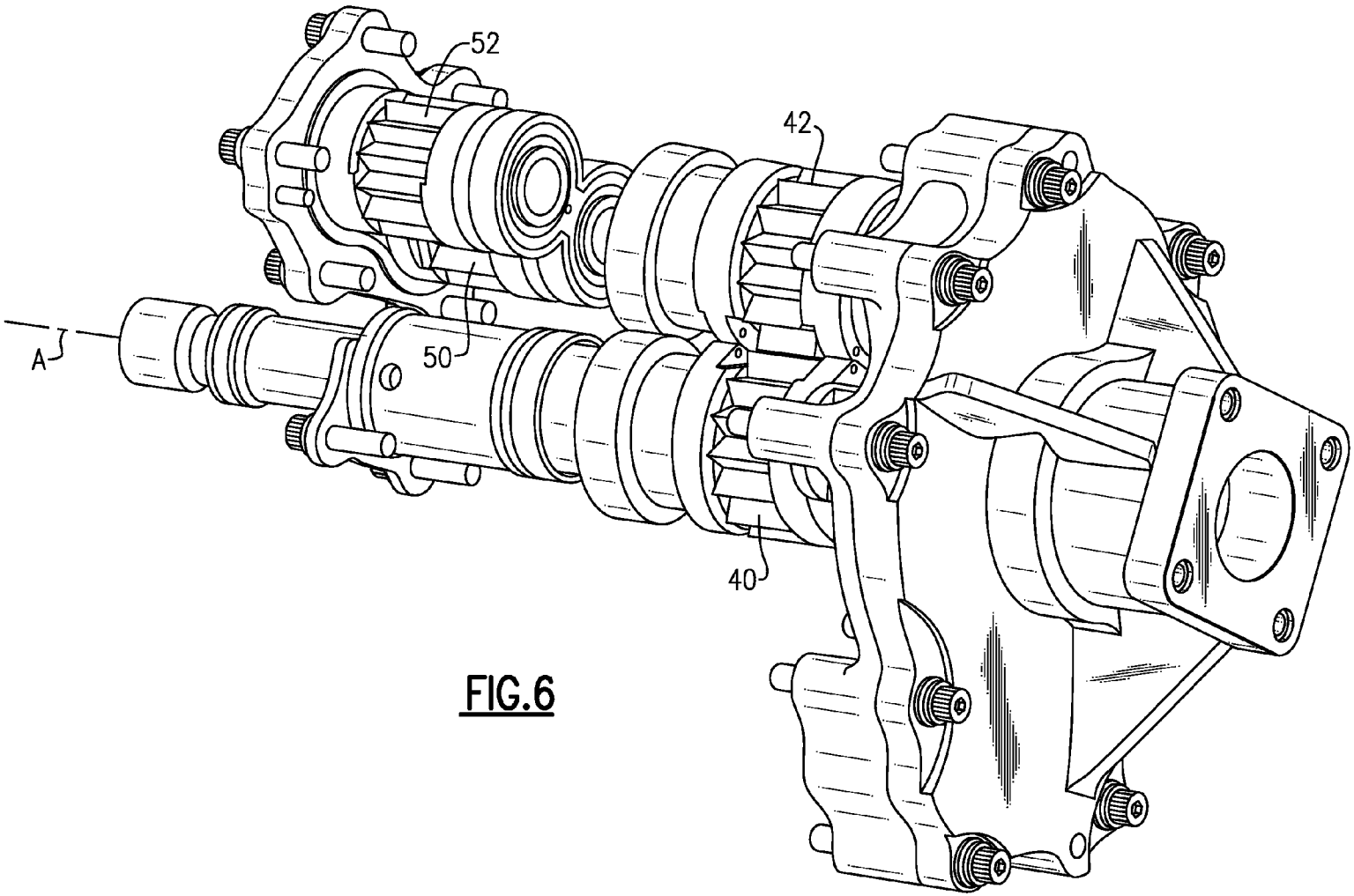
FIG. 6 is another perspective view of the gear pump with the housing removed.
Figure 7:
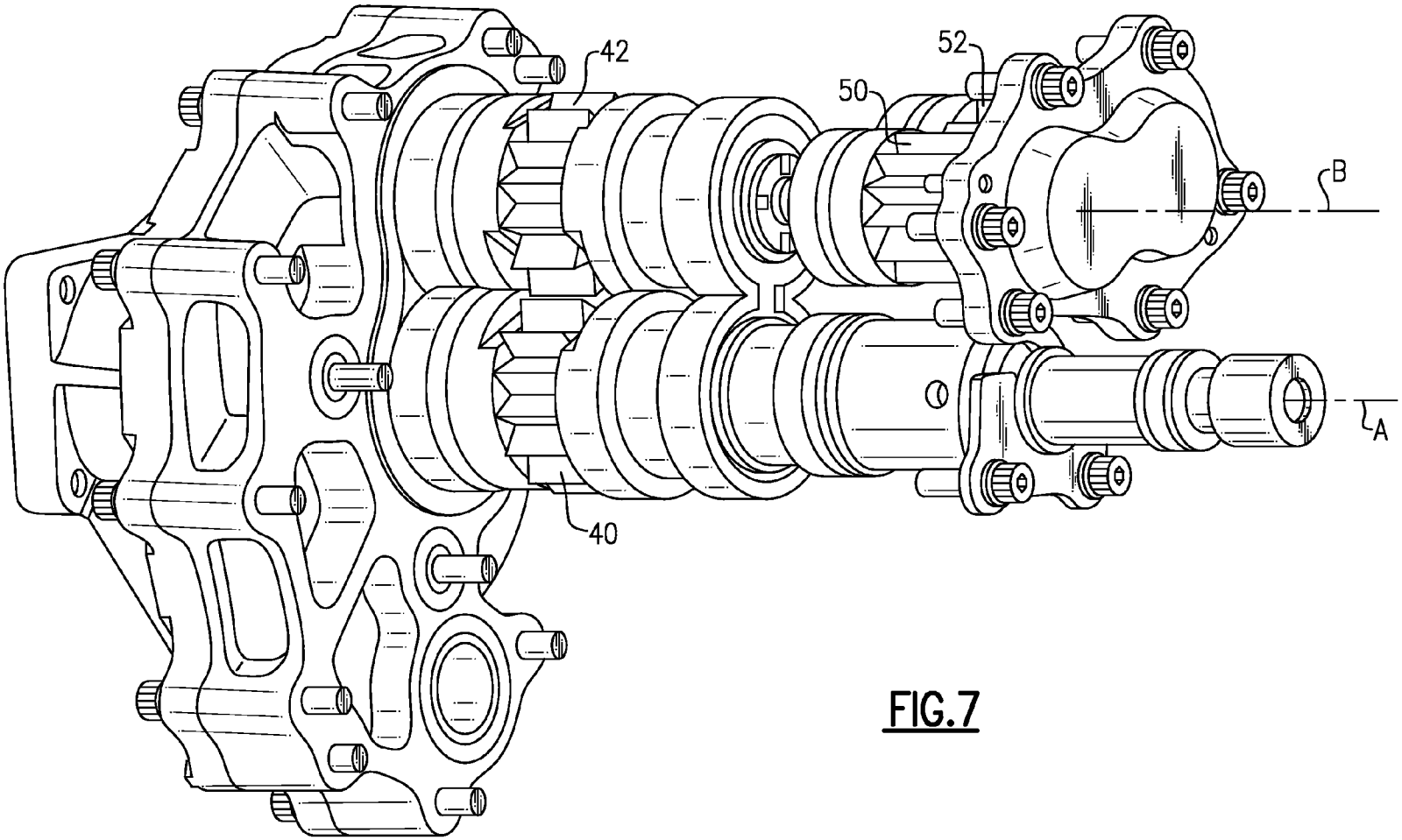
FIG. 7 is another perspective view of the gear pump with the housing removed.

The main drive gear 40 is in meshed engagement with the main driven gear 42 and the motive drive gear 50 is in meshed engagement with the motive driven gear 52 (FIGS. 5-7). The input shaft assembly 32 drives the coupling shaft assembly 34 through the main stage 36 to drive the motive stage 38. A boost stage 58 is also driven by the input shaft assembly 32 to define a centrifugal pump with an impeller and integrated inducer.

Figure 8:
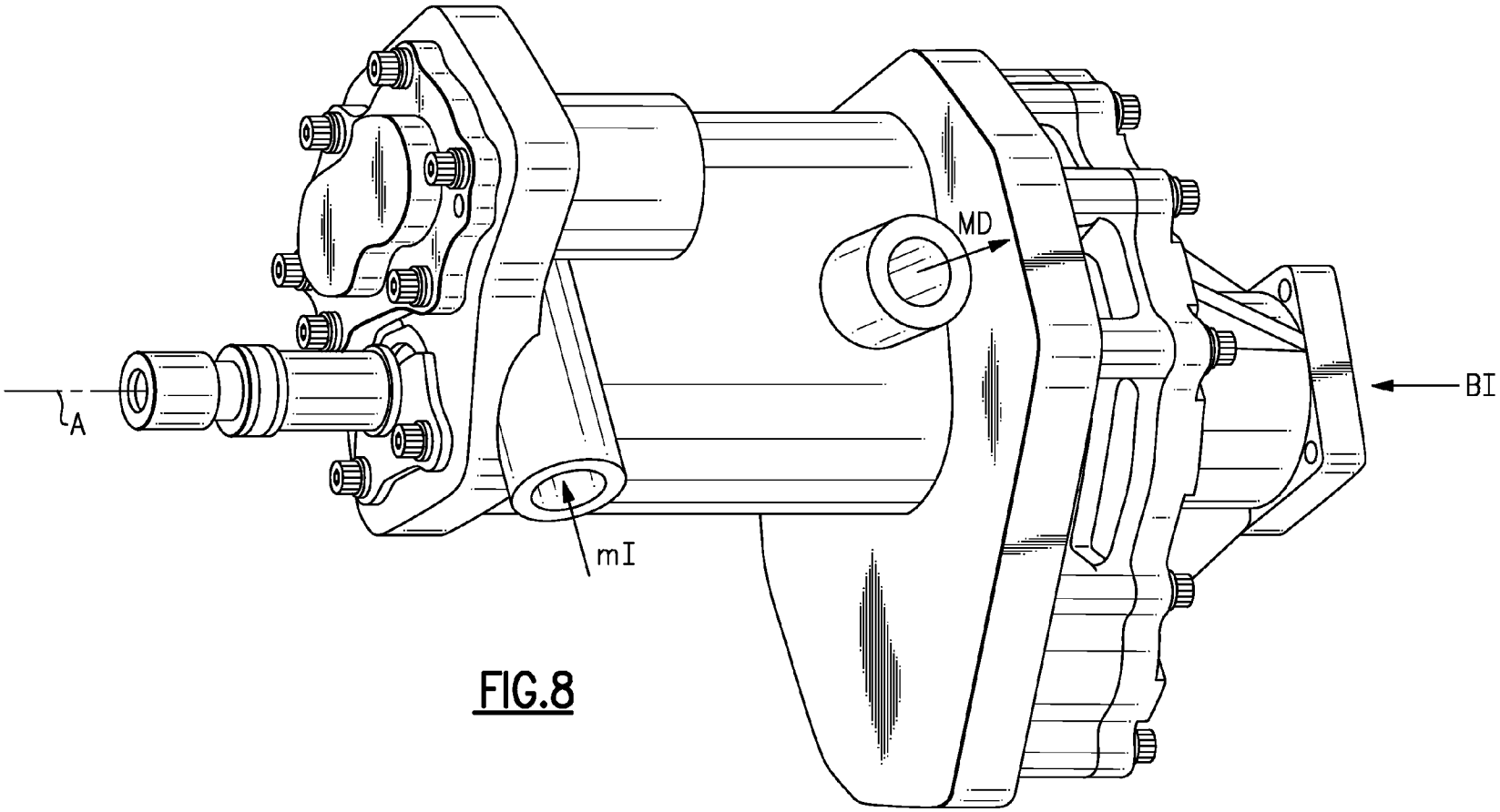
FIG. 8 is a perspective view of the gear pump from the same perspective as in FIG. 5.
Figure 9:
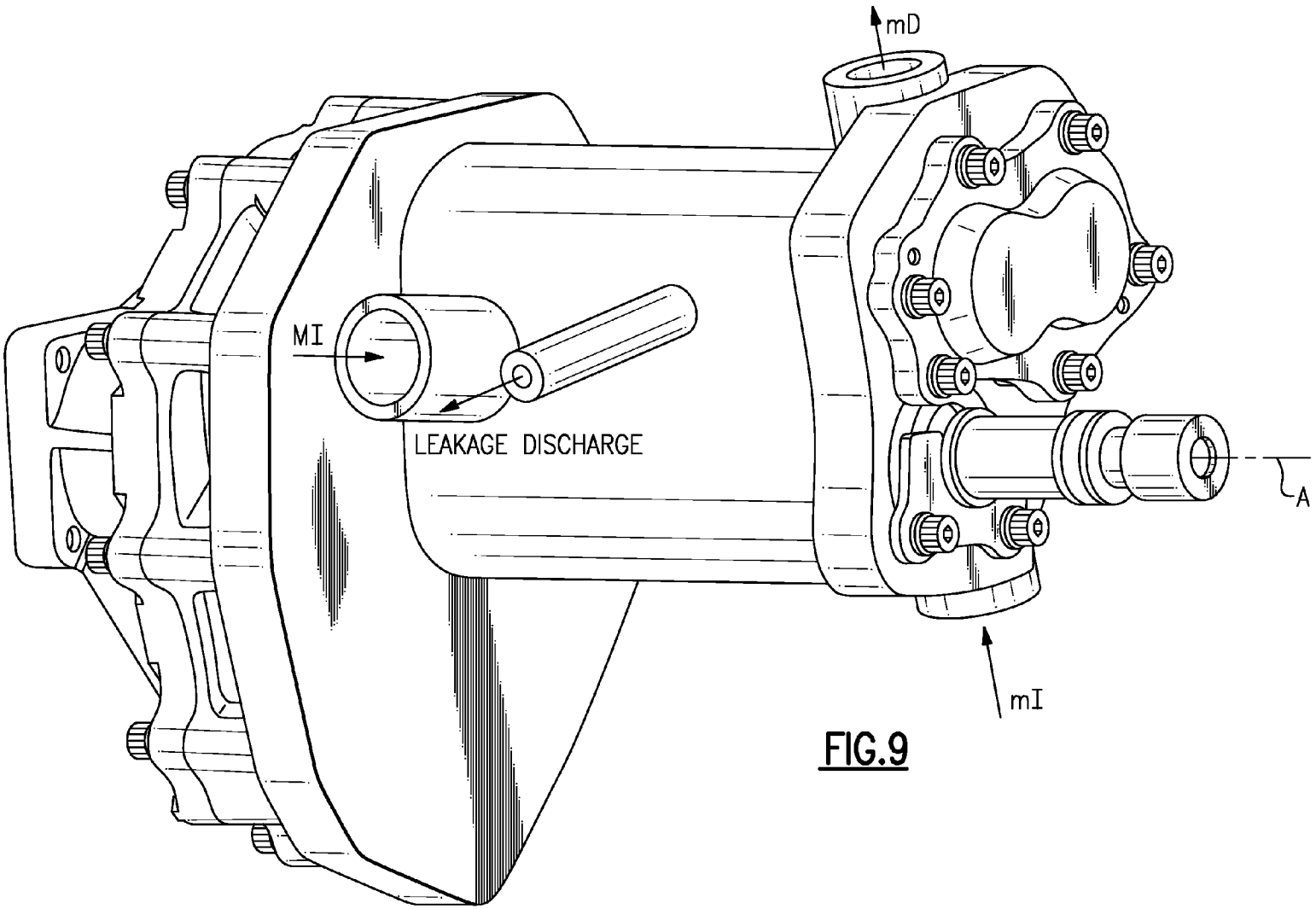
FIG. 9 is a perspective view of the gear pump from the same perspective as in FIG. 7.
Figures 10, 12:
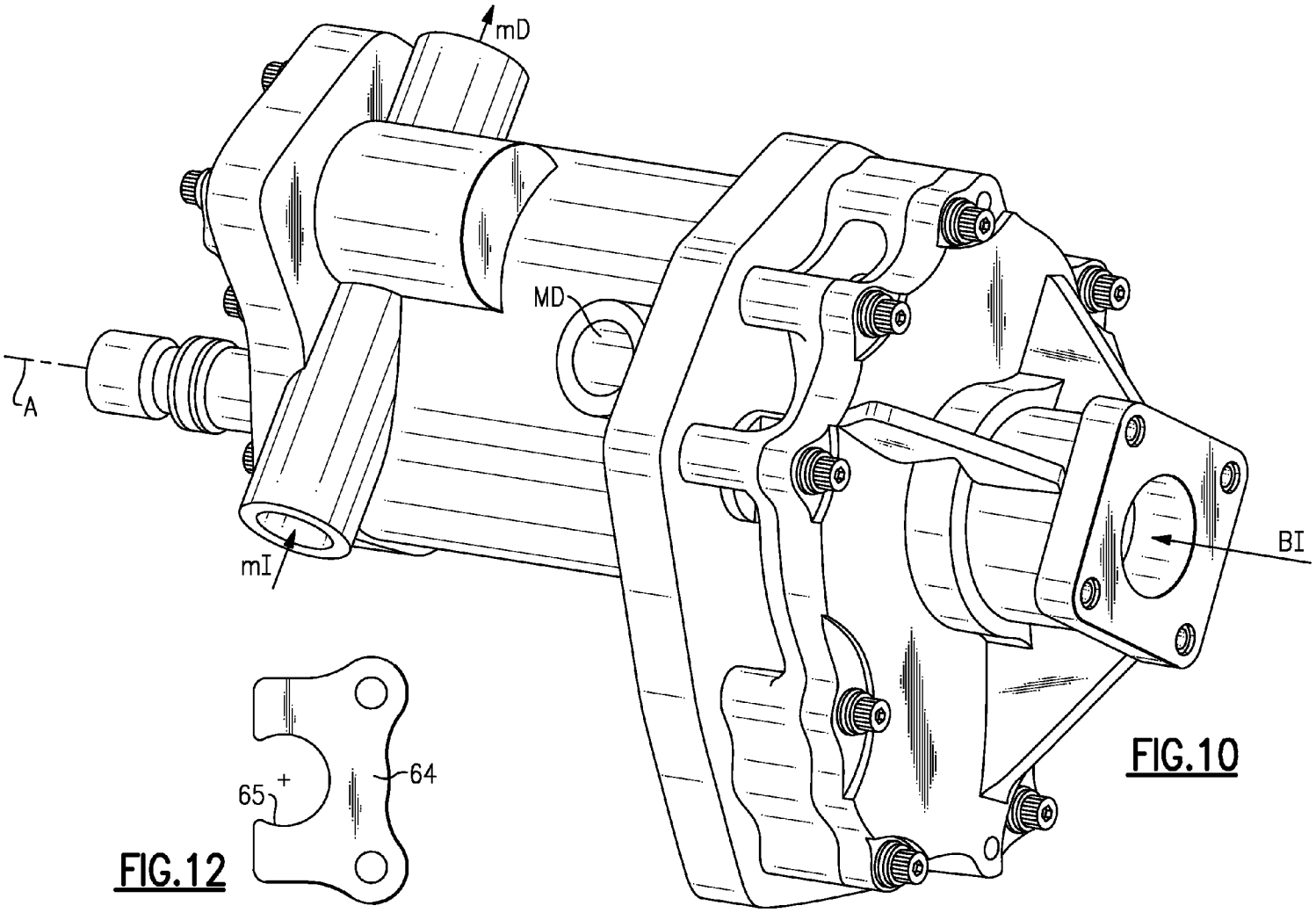
FIG. 10 is a perspective view of the gear pump from the same perspective as in FIG. 6.
FIG. 12 is an end view of a retainer plate of the input shaft assembly.

The stages 36, 38, 58 work mostly independently. Each stage 36, 38, 58 includes a separate inlet and discharge (FIGS. 8-10). As the meshed gears 40, 42 and 50, 52 rotate, respective volumes of fluid are communicated from the main stage inlet MI to the main stage discharge MD and from a motive stage inlet ml to a motive stage discharge mD such that the main stage 36 communicates a main fuel flow while the motive stage 38 supplies a motive fuel flow. The main stage inlet MI and main stage discharge MD as well as the motive stage inlet ml and motive stage discharge mD are respectively directed along generally linear paths through the respective gear stage 36, 38.

In the disclosed non-limiting embodiment, an aircraft fuel system provides flow and pressure to the boost stage inlet BI. A portion of the boost stage discharge is routed internally to the motive stage inlet mI. The remainder of the boost stage discharge is discharged from the gear pump 20 to the aircraft fuel system, then returns to the main stage inlet MI. The motive stage discharge mD is communicated to the aircraft fuel system. The main stage discharge MD is also communicated to the aircraft fuel system to provide at least two main functions: actuation and engine burn flow. There may be alternative or additional relatively minor flow directions and functions, but detailed description thereof need not be further disclosed herein.

Figure 11:
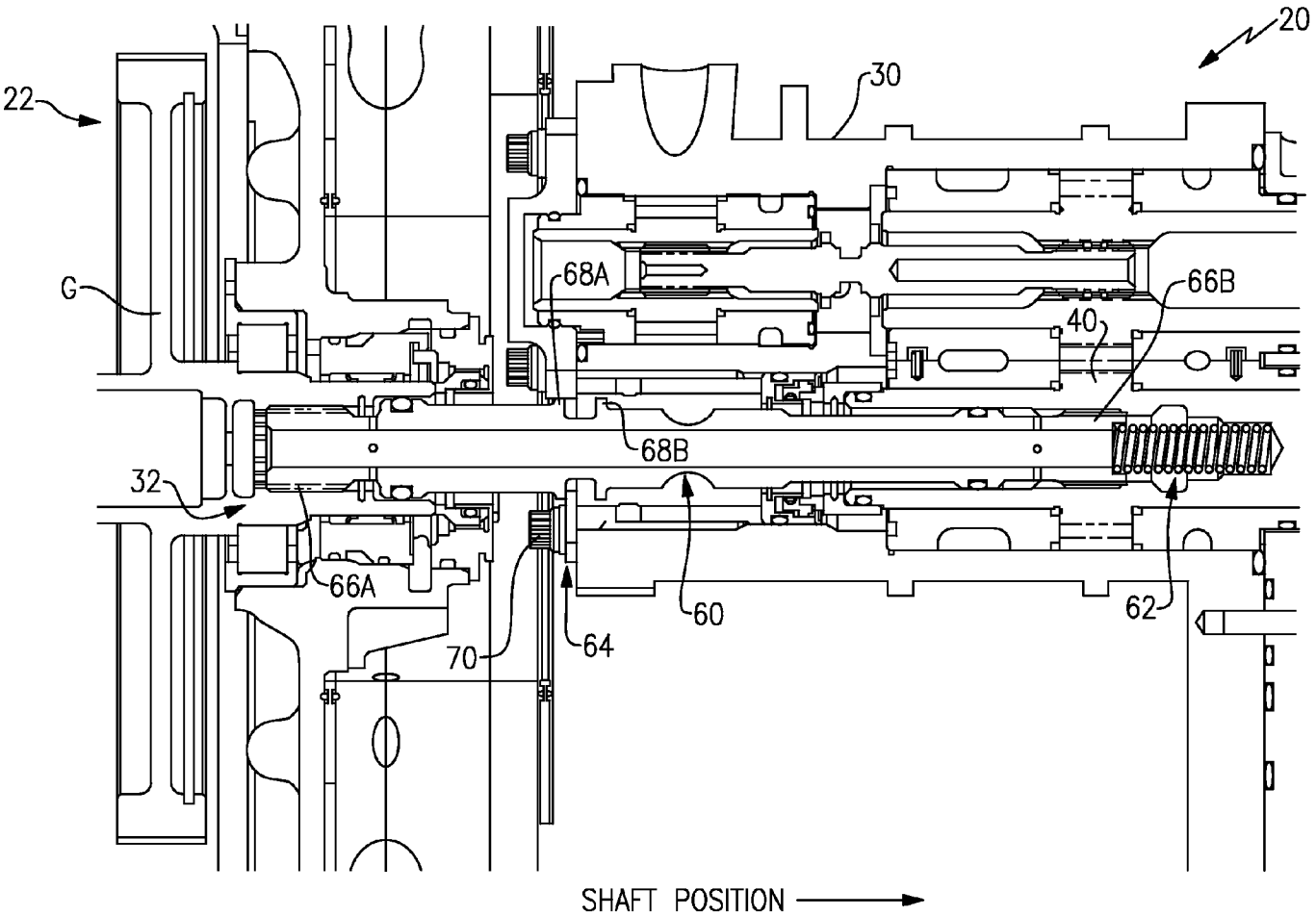
FIG. 11 is an expanded sectional view of an input shaft assembly of the gear pump.

With reference to FIG. 11, the input shaft assembly 32 includes an input shaft 60, a spring 62 and a retainer plate 64. The input shaft 60 is a hollow shaft with splined end sections 66A, 66B and radial shoulders 68A, 68B therebetween. The splined end section 66A plugs into a gear G of the accessory gearbox 22. The splined end section 66B interfaces with the main drive gear 40. The splined end sections 66A, 66B need to be properly lubricated during operation to minimize wear and meet all performance requirements throughout service life. Using a fluid lubricant such as oil from within the accessory gearbox 22, the lubrication is continually supplied, drained and replenished at the spline interfaces 66A, 66B.

The radial shoulders 68A, 68B are generally aligned with the housing 30 to receive the retainer plate 64 therebetween. The retainer plate 64 is attached to the housing 30 through fasteners 70 such as bolts (also illustrated in FIG. 2) to position an interrupted opening 65 between the radial shoulders 68A, 68B. The interrupted opening 65 in one disclosed non-limiting embodiment is an arcuate surface with an interruption less than 180 degrees (FIG. 12). The axial position of the input shaft 60 is thereby axially constrained by the interaction of the radial shoulders 68A, 68B and to the retainer plate 64.

Figure 13:
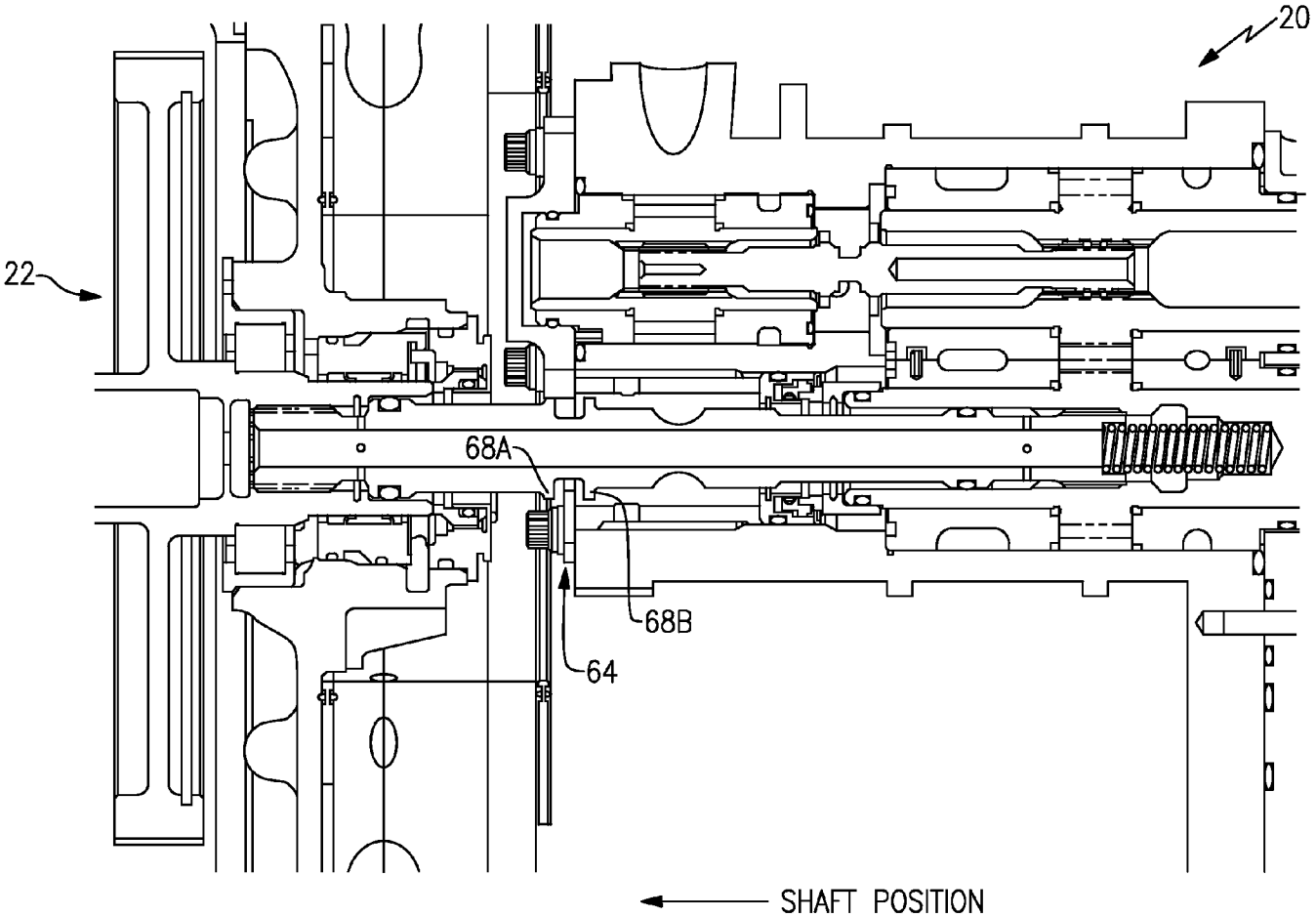
FIG. 13 is an expanded sectional view of an input shaft assembly of the gear pump in an operational position.

With reference to FIG. 13, the spring 62 biases the input shaft assembly 32 to position the input shaft assembly 32 during gear pump operation. That is, the spring 62 allows the input shaft assembly 32 to move in the housing 30 in response to impact loads, until the input shaft assembly 32 bottoms out on the retainer plate 64, but during operation, the spring 62 positions the input shaft assembly 32 such that the radial shoulders 68A, 68B are spaced from the retainer plate 64. This assures there are no rotational to stationary part contact during operation.

Figure 14A:
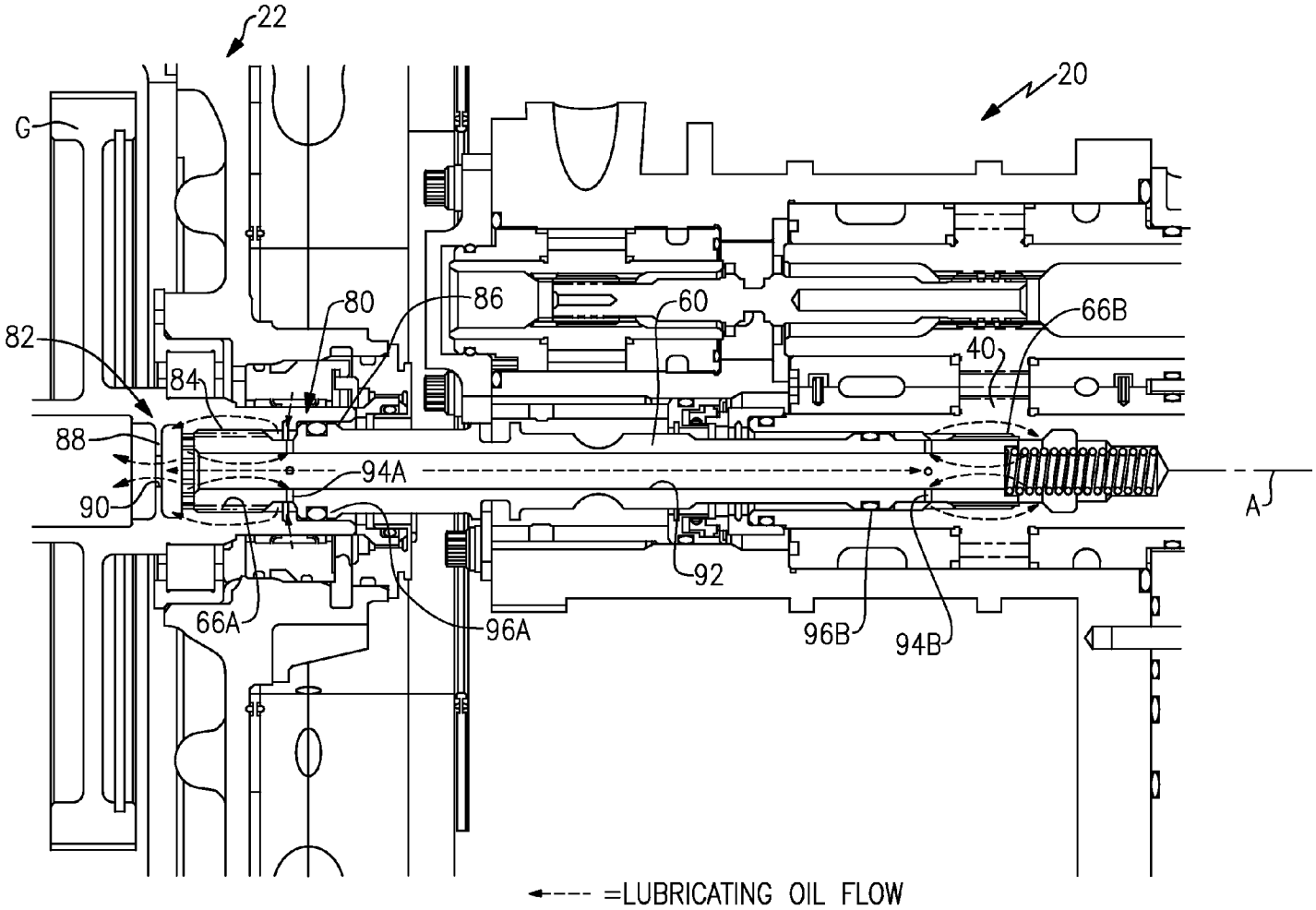
FIG. 14A is an expanded sectional view of an input shaft assembly of the gear pump in an operational position.
Figure 14B:
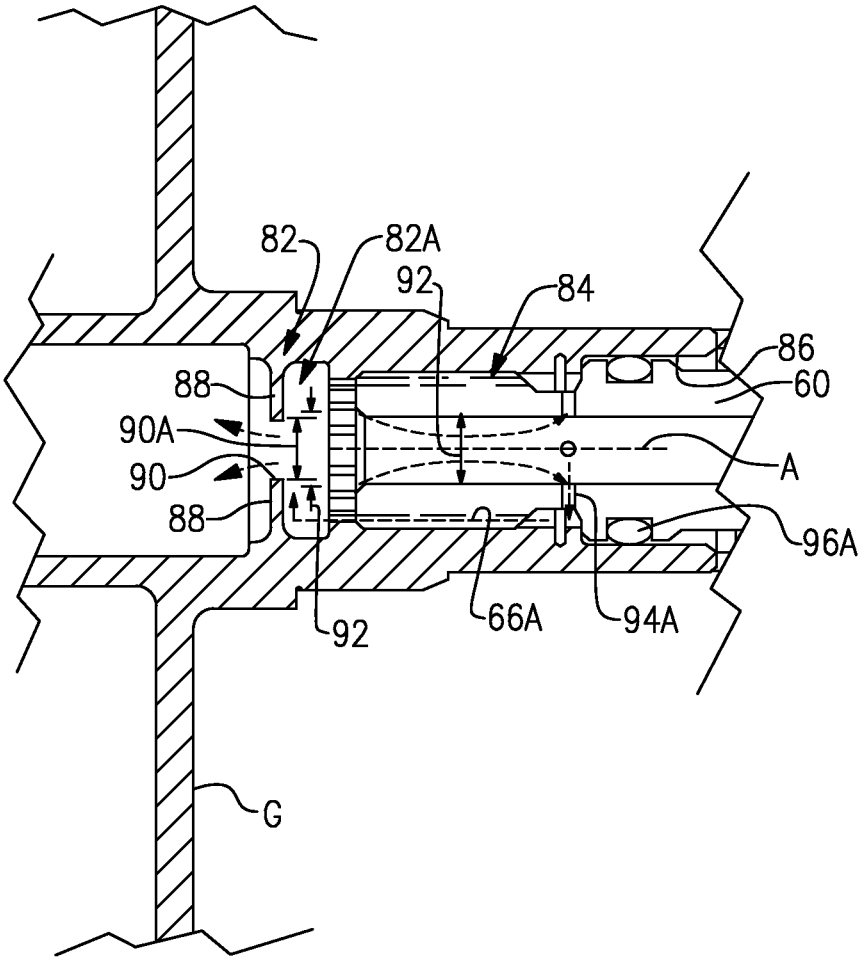
FIG. 14B is an expanded, isolated view from FIG. 14A of a gear and oil dam.

With reference to FIGS. 14A and 14B, the gear G includes a splined bore 80 with an oil dam 82, a splined section 84 axially inboard of the oil dam 82 and a smooth bore section 86 axially inboard of the splined section 84. The oil dam 82 generally includes a shoulder 88 and an inner aperture 90, having a diameter 90A, along the shaft axis A which communicates with the accessory gearbox 22.

The input shaft 60 includes a first and second set of radial apertures 94A, 94B adjacent to splines 66A, 66B. A radial seal structure 96A, 96B extends from the input shaft 60 in an axial inboard position relative to a set of radial apertures 94A, 94B to seal the shaft 60 respectively to the gear G and the main drive gear 40. The radial seal structure 96A interfaces with the smooth bore section 86 of the gear G and the radial seal structure 96B interfaces with the main drive gear 40 such that lubricant circulates over the splines 66A, 66B and communicates therebetween through a hollow inner bore diameter 92 of the input shaft 60.

Lubricant initially radially enters the input shaft 60 hollow inner bore diameter 92 through either the first set of radial apertures 94A or through the spline 66A. Because the inner bore diameter 92 of the shaft 60 is greater than the diameter 90A of the inner aperture 90, lubricant collects in a reservoir 82A of the oil dam 82 until the lubricant reaches the hollow inner bore diameter 92. That is, as the shaft 60 rotates, the lubricant is thrown radially outwards with respect to the axis A and thus collects in the reservoir 82A until it exceeds the level of the shoulder 88. As the lubricant collects in reservoir 82A of the oil dam 82, the lubricant cannot escape through the inner aperture 90 until there is enough lubricant in the reservoir to flow over the shoulder 88. Lubricant thus collects in the reservoir 82A, at the spline 66A. and in the input shaft 60 such that lubricant also flows down the hollow inner bore diameter 92 and lubricates the spline 66B through either the second set of radial apertures 94B or through an end section of the hollow inner bore diameter 92 and end of the input shaft 60. Rotation of the input shaft 60 further facilitates radial flow of the lubricant through the sets of radial apertures 94A, 94B. When the lubricant level surpasses the shoulder 88, the lubricant flows over the shoulder 88 of the oil dam 82 and drains into the accessory gearbox 22. A predetermined quantity of lubricant is thereby maintained within the input shaft 60 and through rotation, circulates radially to the spline 66A, 66B through the sets of radial apertures 94A, 94B and end sections of the input shaft 60. Thus, the oil dam 82 facilitates the continual supply, draining, and replenishing of lubricant to the splines 66A, 66B for proper spline lubrication. It should further be understood that the lubricant flow may be in either direction such that the flow can also exit through the sets of radial apertures 94A, 94B or from the end sections of the hollow inner bore diameter 92. That is, the lubricant flows along the least path resistance which may change dynamically.

Figure 15:
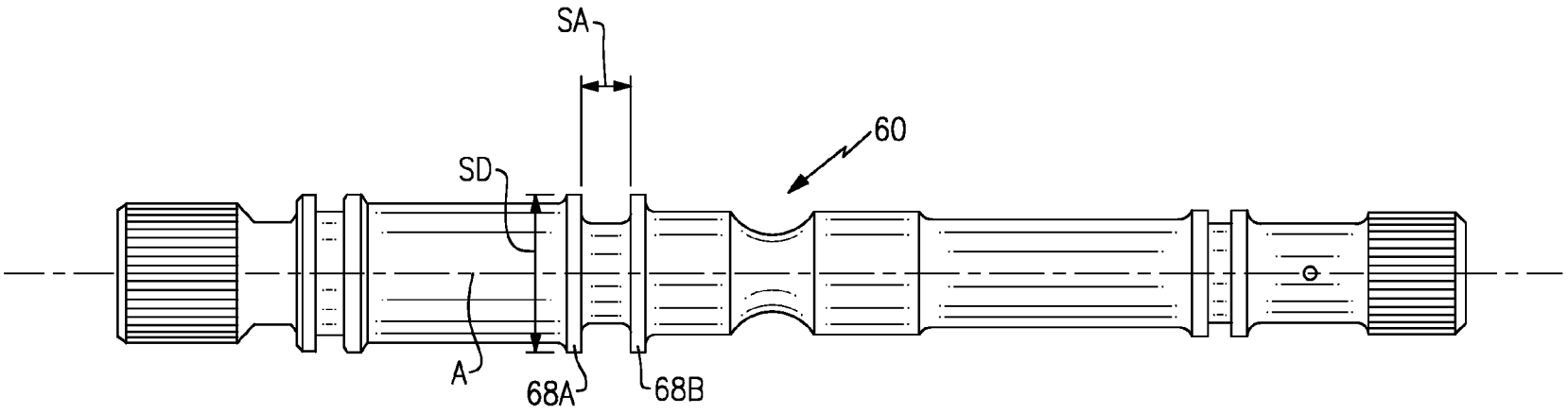
FIG. 15 is an expanded side view of the input shaft assembly illustrating a dimensional relationship between radial shoulders.

With reference to FIG. 15, the separation between the radial shoulders 68A, 68B defines an axial distance SA along the axis of rotation A and each of the radial shoulders 68A, 68B defines a diameter SD of each of the radial shoulders 68A, 68B.

The axial dimension SA in one disclosed non-limiting dimensional embodiment is 0.210-0.410 inches (5.3-10.4 mm) with a nominal dimension 0.310 inches (7.9 mm). The diameter SD in this disclosed non-limiting dimensional embodiment is 1.100-0.900 inches (28.0-22.9 mm) and a nominal diameter of 1.000 inches (25.4 mm). In this disclosed non-limiting dimensional embodiment, a ratio of SA/SD is defined between 0.19-0.45.

The disclosed ratios permit axial movement of the input shaft 60 defined in part by the distance between the radial shoulders 68A, 68B yet assures proper lubricant flow and effective splined engagement.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A shaft assembly comprising:

a gear rotatable about an axis, said gear including a gear bore having a splined bore section and an oil dam, said oil dam including a shoulder extending radially inwardly from said gear bore such that said shoulder forms an inner aperture along said axis, said inner aperture having an aperture diameter; and a shaft with a first splined end section engageable with said splined bore section such that there is a reservoir axially between said first splined end section and said shoulder of said gear bore, said shaft having a shaft inner bore with a bore diameter, a first set of radial apertures axially inboard of said first splined end section and in communication with said shaft inner bore and said reservoir across said first splined end section, said bore diameter being greater than said aperture diameter of said inner aperture of said shoulder such that lubricant collects at said oil dam in said reservoir, at said first splined end section, and in said bore diameter until the lubricant in the reservoir flows over the shoulder.

2. The shaft assembly as recited in claim 1, further comprising a first radial shoulder and a second radial shoulder, an axial separation between said first radial shoulder and said second radial shoulder defines an axial distance SA along said axis and each of said radial shoulders defines an outer diameter SD, a ratio of SA/SD defined between 0.19 -0.45.

3. The shaft assembly as recited in claim 1, wherein said inner aperture of said shoulder is co-axial with said shaft.

4. The shaft assembly as recited in claim 1, further comprising a radial seal structure engageable with said gear bore downstream of said first set of radial apertures.

5. A gear pump comprising:

a housing;

a first gear rotatable about an axis, said first gear including a gear bore having a splined bore section and an oil dam, said oil dam including a shoulder extending radially inwardly from said gear bore such that said shoulder forms an inner aperture along said axis, said inner aperture having an aperture diameter;

an input shaft which at least partially extends from said housing along said axis, said input shaft with a first splined end section and a second splined end section, said first splined end section engageable with said splined bore section, said input shaft having a shaft inner bore with a bore diameter, a first set of radial apertures axially inboard of said first splined end section and in communication with said shaft inner bore and said reservoir across said first splined end section, said bore diameter being greater than said aperture diameter of said inner aperture of said shoulder such that lubricant collects at said oil dam in said reservoir, at said first splined end section, and in said bore diameter until the lubricant in the reservoir flows over the shoulder, and a second set of radial apertures axially inboard of said second splined end section in communication with said shaft inner bore; and a coupling shaft along a coupling shaft axis parallel to said axis.

6. The gear pump as recited in claim 5, wherein said first gear is a first drive gear mounted to said input shaft and in meshed engagement with a first driven gear mounted to said coupling shaft, and a second drive gear is also mounted to said coupling shaft in meshed engagement with a fourth driven gear.

7. The gear pump as recited in claim 5, further comprising a first radial shoulder and a second radial shoulder, an axial separation between said first radial shoulder and said second radial shoulder defines an axial distance SA along said axis and each of said radial shoulders defines an outer diameter SD, a ratio of SA/SD defined between 0.19 -0.45.

8. The gear pump as recited in claim 5, wherein said inner aperture is coaxial with said input shaft.

9. A method of installing a shaft comprising:

a gear that is rotatable about an axis, said gear including a gear bore having a splined bore section and an oil dam, said oil dam including a shoulder extending radially inwardly from said gear bore such that said shoulder forms an inner aperture along said axis, said inner aperture having an aperture diameter; and installing a shaft with a first splined end section into said splined bore section such that there is a reservoir axially between said first splined end section and said shoulder of said gear bore, said shaft having a shaft inner bore with a bore diameter, a first set of radial apertures axially inboard of said first splined end section and in communication with said shaft inner bore and said reservoir across said first splined end section, said bore diameter being greater than said aperture diameter of said inner aperture of said shoulder such that lubricant collects at said oil dam in said reservoir, at said first splined end section, and in said bore diameter until the lubricant in the reservoir flows over the shoulder.

10. The method as recited in claim 9, further comprising:

sealing the shaft within the gear axially inboard of the first set of radial apertures.

11. The method as recited in claim 10, wherein the sealing of the shaft includes sealing with an o-ring seal.

* * * * *

UNITED STATES PATENT AND TRADEMARK OFFICE

CERTIFICATE OF CORRECTION

PATENT NO. : 8,992,192 B2
APPLICATION NO. : 13/034965
DATED : March 31, 2015
INVENTOR(S) : Satish Shantilal Shah It is certified that error appears in the above-identified patent and that said Letters Patent is hereby corrected as shown below:

IN THE CLAIMS:

In claim 5, column 6, line 11; after “and” remove “said” and replace with --a--

Signed and Sealed this
Sixth Day of October, 2015

Michelle K. Lee

Michelle K. Lee
*Director of the United States Patent and Trademark Office*